US005861237A

United States Patent [19]

Takaki

[11] Patent Number: 5,861,237

[45] Date of Patent: Jan. 19, 1999

[54] PHOTOGRAPHIC ELEMENT AND DIFFUSION TRANSFER PHOTOGRAPHIC LIGHT-SENSITIVE MATERIAL USING THE SAME

[75] Inventor: Hideki Takaki, Minami-ashigara, Japan

[73] Assignee: Fuji Photo Film Co., Ltd., Kanagawa, Japan

[21] Appl. No.: 923,993

[22] Filed: Sep. 5, 1997

[30] Foreign Application Priority Data

Sep. 6, 1996 [JP] Japan ..... 8-236253

[51] Int. Cl.[6] ..... G03C 1/795; G03C 1/93; G03C 8/52

[52] U.S. Cl. ..... 430/532; 430/212; 430/215; 430/531; 430/536; 428/420; 428/476.6; 428/478.4

[58] Field of Search ..... 430/212, 215, 430/531, 536, 532; 428/420, 476.6, 478.4

[56] References Cited

U.S. PATENT DOCUMENTS 3,793,022 2/1974 Land et al. ..... 430/220
3,925,081 12/1975 Chiklis ..... 430/220
3,938,999 2/1976 Yoneyama et al. ..... 430/536
4,066,814 1/1978 Chiklis ..... 428/333
4,267,262 5/1981 Karino et al. ..... 430/215
4,868,088 9/1989 Aono et al. ..... 430/215
4,916,044 4/1990 Tomiyama et al. ..... 430/216

*Primary Examiner*—Richard L. Schilling
*Attorney, Agent, or Firm*—Birch, Stewart, Kolasch & Birch, LLP

[57] ABSTRACT

A photographic element is disclosed, comprising a support having a gelatin undercoat, having provided thereon an acetylcellulose layer containing from 1.0 to 12.0 wt % of a polymer represented by formula (1) and from 5 to 40 wt % of a compound having at least two isocyanate groups, both based on acetylcellulose contained in the acetylcellulose layer. Also disclosed is a diffusion transfer photographic light-sensitive material comprising a photographic element comprising a support having a gelatin undercoat, having provided thereon an acetylcellulose layer containing from 2.0 to 9.0 wt % of a polymer represented by formula (1) and from 5 to 20 wt % of a compound having at least two isocyanate group, both based on acetylcellulose contained in the acetylcellulose layer.

7 Claims, No Drawings

PHOTOGRAPHIC ELEMENT AND DIFFUSION TRANSFER PHOTOGRAPHIC LIGHT-SENSITIVE MATERIAL USING THE SAME

FIELD OF THE INVENTION

The present invention relates to a photographic element, more specifically, the present invention relates to a method for improving adhesion of the acetylcellulose layer in a diffusion transfer photograph.

BACKGROUND OF THE INVENTION

So-called mono-sheet instant photographs in general are used in the form of a film unit comprising a light-sensitive sheet comprising a support having thereon at least one light-sensitive silver halide emulsion layer, a cover sheet comprising a different support having thereon at least an acid polymer layer for neutralization, and a container, which can be ruptured by pressure, containing an alkaline developer and interposed between two sheets. The side of the light-sensitive sheet not having the light-sensitive silver halide emulsion layer and the side of the cover sheet not having the acid polymer layer become outermost layers of the film unit and therefore, a back layer containing a slipping agent for achieving good delivery from the camera or an ultraviolet absorbent for preventing deterioration of the image due to ultraviolet ray, is often provided thereon. The binder of this back layer is preferably a hydrophobic polymer in view of water resistance because the layer is the outermost face. On the other hand, the support on which the acetylcellulose is coated is, in the case of a photographic light-sensitive material, generally subjected to gelatin undercoating. However, when the acetylcellulose film is merely coated on the gelatin-undercoated support, the adhesion between layers are poor and the layer coated is easily peeled off.

Accordingly, a method of improving the interlayer adhesion is being attempted, for example, by replacing the gelatin undercoat by nitrocellulose undercoat having physicochemical properties analogous to those of the acetylcellulose film, however, this requires a special process and is not preferred in view of the cost.

Further, a technique of providing a so-called primer layer between layers so as to improve the interlayer adhesion is disclosed in U.S. Pat. Nos. 4,297,432 and 4,297,195, European Patent Publication 45692A2, JP-A-57-58148 (the term "JP-A" as used herein means an "unexamined published Japanese patent application"), JP-A-57-58146 and JP-A-59-65842, however, one layer increases in the layer structure and this is either not preferred in view of the cost.

SUMMARY OF THE INVENTION

An object of the present invention is to provide a photographic element comprising a gelatin-undercoated support having provided thereon an acetylcellulose layer having a good adhesive property.

Another object of the present invention is to provide a diffusion transfer photographic film unit containing the above-described photographic element.

As a result of extensive investigations, the present inventors have found that the above-described objects can be effectively attained by:

(1) a photographic element comprising a support having a gelatin undercoat, having provided thereon an acetylcellulose layer containing from 1.0 to 12.0 wt % of a polymer represented by the following formula (1) and from 5 to 40 wt % of a compound having at least two isocyanate groups, both based on acetylcellulose contained in the acetylcellulose layer:

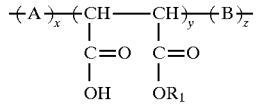

(1)

wherein A represents a polymerized comonomer component represented by formula (2), $R_1$ represents an alkyl group, an aryl group or an aralkyl group, B represents another polymerized ethylenical comonomer component, x represents from 20 to 90 mol %, y represents from 10 to 80 mol %, and z represents from 0 to 30 mol %:

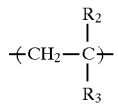

(2)

wherein $R_2$ represents a hydrogen atom, a halogen atom or a methyl group, $R_3$ represents a hydrogen atom, a halogen atom, an alkyl group, an aryl group, a $—(CH_2)_n—O—R_4$ group, a $—(CH_2)_n—O—CO—R_5$ group or a $—CO—O—R_6$ group, $R_4$ represents an alkyl group or an aralkyl group, $R_5$ and $R_6$, which may be the same or different, each represents an alkyl group, an aryl group or an aralkyl group, and n represents 0 or 1;

(2) a photographic element comprising a support having a gelatin undercoat, having provided thereon an acetylcellulose layer containing from 2.0 to 9.0 wt % of a polymer represented by formula (1) in item (1) and from 5 to 20 wt % of a compound having at least two isocyanate group, both based on acetylcellulose contained in the acetylcellulose layer; and (3) a diffusion transfer photographic light-sensitive material comprising a photographic element described in item (2).

DETAILED DESCRIPTION OF THE INVENTION

The polymer represented by the following formula (1) for use in the present invention is described below.

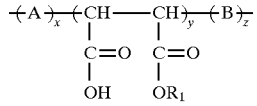

(1)

wherein A represents a polymerized comonomer component represented by formula (2), $R_1$ represents an alkyl group preferably having from 1 to 12 carbon atoms, an aryl group preferably having from 6 to 12 carbon atoms or an aralkyl group preferably having from 7 to 10 carbon atoms, B represents another polymerized ethylenical comonomer component, x represents from 20 to 90 mol %, y represents from 10 to 80 mol %, and z represents from 0 to 30 mol %:

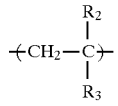

(2)

wherein $R_2$ represents a hydrogen atom, a halogen atom or a methyl group, $R_3$ represents a hydrogen atom, a halogen atom, an alkyl group preferably having from 1 to 12 carbon atoms, an aryl group preferably having from 6 to 12 carbon atoms, a $—(CH_2)_n—O—R_4$ group, a $—(CH_2)_n—O—CO—$ $R_5$ group or a —CO—O—$R_6$ group, $R_4$ represents an alkyl group preferably having from 6 to 12 carbon atoms or an aralkyl group (preferably a benzyl group), $R_5$ and $R_6$, which may be the same or different, each represents an alkyl group preferably having from 1 to 8 carbon atoms, an aryl group preferably having from 6 to 12 carbon atoms or an aralkyl group preferably having from 7 to 10 carbon atoms, and n represents 0 or 1.

In formulae (1) and (2), the alkyl group includes an unsubstituted alkyl group and a substituted alkyl group, and the aryl group or the aryl moiety in the aralkyl group includes an unsubstituted aryl group and a substituted aryl group. Examples of the substituent of the alkyl group represented by $R_1$ or $R_4$ include a halogen atom (e.g., chlorine, bromine, fluorine) and an alkoxy group preferably having from 1 to 6 carbon atoms. Examples of the substituent of the aryl group or the aryl moiety of the aralkyl group represented by $R_1$ include a hydroxy group, a halogen atom (e.g., chlorine, bromine, fluorine) and an acyl group (e.g., acetyl). Examples of the substituent of the aryl group represented by $R_3$ include an acyl group (e.g., acetyl), a hydroxy group, a halogen atom (e.g., chlorine, bromine, fluorine), an alkyl group preferably having from 1 to 4 carbon atoms and an alkoxy group preferably having from 1 to 4 carbon atoms. Examples of the substituent of the alkyl group represented by $R_5$ include a halogen atom (e.g., chlorine, bromine, fluorine). Examples of the substituent of the aryl group or the aryl moiety of the aralkyl group represented by $R_5$ include a halogen atom (e.g., chlorine, bromine, fluorine), an alkyl group preferably having from 1 to 4 carbon atoms and an alkoxy group preferably having from 1 to 4 carbon atoms. Examples of the substituent of the alkyl group represented by $R_6$ include a halogen atom (e.g., chlorine, bromine, fluorine), an acyl group (e.g., acetyl) and a tetrahydrofuryl group. Examples of the aryl group or the aryl moiety of the aralkyl group represented by $R_6$ include an acyl group (e.g., acetyl), a halogen atom (e.g., chlorine, bromine, fluorine), an alkyl group preferably having from 1 to 4 carbon atoms and an alkoxy group preferably having from 1 to 4 carbon atoms. Examples of the halogen atom represented by $R_2$ or $R_3$ include a chlorine atom, a bromine atom and a fluorine atom.

The polymer represented by formula (1) can be synthesized by the copolymerization reaction of a maleic monoester or a fumaric monoester with monomers giving Component A and Component B, respectively, or may be synthesized by esterifying the polymer obtained by the copolymerization reaction of maleic anhydride with monomers giving component A and Component B, respectively, with alcohol.

More specifically, examples of the monomer giving Component A include olefins, styrenes, vinyl ethers, vinyl esters, allyl compounds, acrylic esters and methacrylic esters.

To state about these monomers more specifically, examples of the olefins include ethylene, propylene, butylene, isobutylene, hexene, dodecene, vinyl chloride and vinylidene chloride; examples of the styrenes include styrene, vinyltoluene, α-methylstyrene, dimethylstyrene, chlorostyrene, bromostyrene and trifluorostyrene; examples of the vinyl ethers include methyl vinyl ether, ethyl vinyl ether, butyl vinyl ether, chloroethyl vinyl ether and benzyl vinyl ether; examples of the vinyl esters include vinyl acetate, vinyl propionate, vinyl butylate, vinyl benzoate, vinyl chloroacetate and vinyl caproate; examples of the allyl compounds include allyl acetate, allyl caproate, allyl butyl ether and allyl octyl ether; examples of the acrylic esters include methyl acrylate, ethyl acrylate, butyl acrylate, octyl acrylate, phenethyl acrylate, benzylacrylate, cyclohexyl acrylate, methoxyethyl acrylate and chloroethyl acrylate; and examples of the methacrylic esters include methyl methacrylate, ethyl methacrylate, propyl methacrylate, butyl methacrylate, lauryl methacrylate, benzyl methacrylate, cyclohexyl methacrylate, chloroethyl methacrylate and ethoxyethyl methacrylate. Among these, olefins, styrenes, vinyl ethers, acrylic esters and methacrylic esters are preferred, and styrenes and vinyl ethers are more preferred.

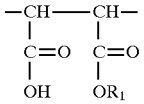

(3)

Specific examples of the monomer giving formula (3) include monomethyl maleate, monoethyl maleate, monobutyl maleate, monooctyl maleate, monododecyl maleate, monomethyl fumarate, monoethyl fumarate, monobutyl fumarate, monooctyl fumarate and monobenzyl maleate.

Examples of the monomer giving Component B include acrylamides, methacrylamides, vinyl heterocyclic compounds, unsaturated nitrile, itaconic acids, maleic diesters, fumaric diesters, crotonic acids and vinyl ketones. To state about these monomers more specifically, examples of the acrylamides include acrylamide, methylacrylamide, butylacrylamide, diethylacrylamide, N-(1,1-dimethyl-3-oxobutyl)acrylamide and acryloylmorpholine; examples of the methacrylamides include methacrylamide, methylmethacrylamide, tert-butylmethacrylamide, phenylmethacylamide, dimethylmethacrylamide, methacryloylmorpholine, methacryloylpiperidine; examples of the vinyl heterocyclic compound include N-vinylpyrrolidone, N-vinyloxazolidone, N-vinyltriazole and N-vinylsuccinimide; examples of the unsaturated nitriles include acrylonitrile, methacrylonitrile and maleonitrile; examples of the itaconic acids include itaconic anhydride, itaconic acid, monoethyl itaconate and dimethyl itaconate; examples of the maleic diesters include dimethyl maleate, diethyl maleate and dibutyl maleate; examples of the crotonic acids include crotonic acid, methyl crotonate and ethyl crotonate; and examples of the vinyl ketones include methyl vinyl ketone, methyl isopropenyl ketone and phenyl vinyl ketone. Among these, acrylamides, methacrylamides, vinyl heterocyclic compounds, unsaturated nitrites, itaconic acids, maleic diesters and fumaric diesters are preferred, and acrylamides, vinyl heterocyclic compounds, unsaturated nitriles and maleic diesters are more preferred.

With respect to the compositional ratio of the copolymer, x is from 20 to 90 mol %, preferably from 30 to 70 mol %, y is from 10 to 80 mol %, preferably from 30 to 50 mol %, and z is from 0 to 30 mol %, preferably from 0 to 20 mol %, more preferably from 0 to 15 mol %.

The weight average molecular weight of the copolymer is not particularly limited, however, in view of solubility, miscibility with acetylcellulose and handling of the polymer, the molecular weight is preferably from 1,000 to 1,000,000, more preferably from 5,000 to 500,000.

The copolymer represented by formula (1) for use in the present invention may be suitably synthesized by referring to the methods described in British Patent 1,211,039, JP-B-47-29195 (the term "JP-B" as used herein means an "examined Japanese patent publication"), Japanese Patent Application Nos. 47-7174 (corresponding to JP-A-48-76593), 47-23466 (JP-A-48-92822) and 48-31355 (corresponding to U.S. Pat. No. 3,963,495), JP-A-49-135619, British Patent 961,359, U.S. Pat. Nos. 3,227,672, 3,290,417, 3,262,919, 3,245,932, 2,681,897 and 3,230,375, John C. Petropoulos et al, *Official Digest,* 33, 719–736 (1961), J. Aoyagi and I. Shinohara, *J. Appl. Polym. Sci.,* 16(Z), 449–460 (1972), *Encyclopedia of Polymer Science and Technology,* 1, 67–95, C. D. Chow, *J. Appl. Polym. Sci.,* 20, 1619–1626 (1976), C. Caze et al, *J. Macromol. Sci.*, A9(1), 29–43 (1975), R. B. Seymour et al, *Polymer,* 17, 21–24 (1976), and *Kobunshi* (*Macromolecule*), 14 (156), 217–223 (1965). One skilled in the art may of course widely and easily change the polymerization initiator, the concentration, the polymerization temperature and the reaction time according to the kind of the polymer synthesized.

For example, the polymerization is usually performed at from 20° to 180° C., preferably from 40° to 120° C. The polymerization reaction is usually performed using from 0.05 to 5 wt % of a radical polymerization initiator based on the monomers polymerized. The initiator includes an azobis compound, a peroxide, a hydroperoxide and a redox catalyst, and specific examples thereof include potassium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide and azobisisobutyronitrile.

Specific typical examples of the copolymer represented by formula (1) for use in the present invention are set forth below, however, the present invention is by no means limited thereto.

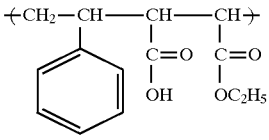

(1)

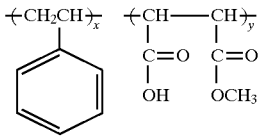

(2)

x:y = 61:39

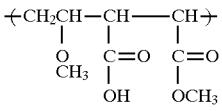

(3)

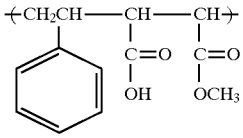

(4)

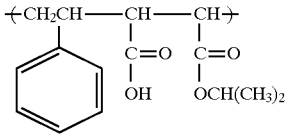

(5)

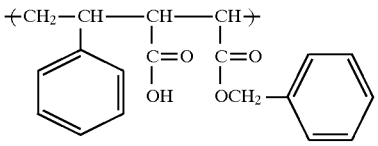

(6)

-continued

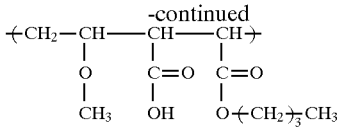

(7)

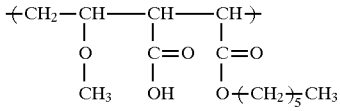

(8)

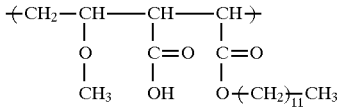

(9)

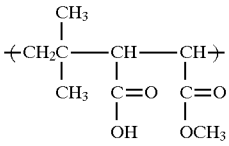

(10)

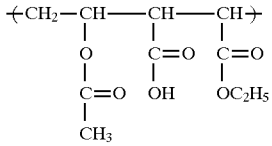

(10)

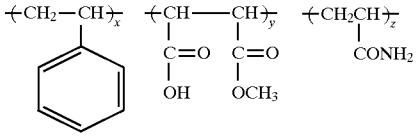

(12)

x:y:z = 48:46.5:5.5

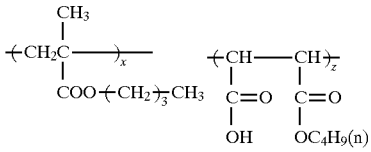

(13)

x:y = 70:30

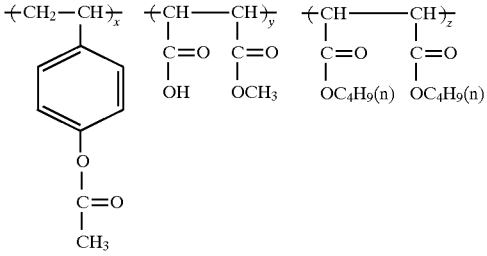

(14)

x:y:z = 60:30:10

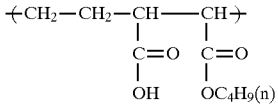

(15)

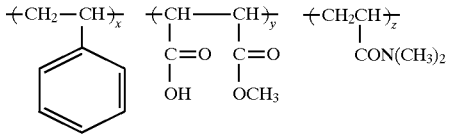

(16)

x:y:z = 40:40:20

-continued (17)

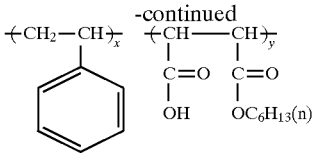

x:y = 65:35

(18)

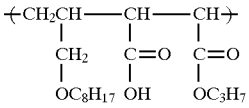

(19)

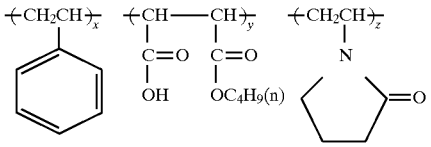

x:y:z = 50:30:20

(20)

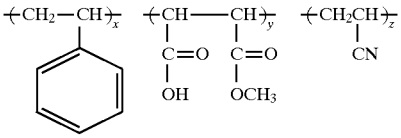

x:y:z = 60:30:10

(21)

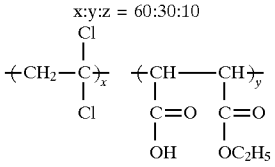

x:y = 60:40

For effectively achieving the objects of the present invention the addition amount of the copolymer represented by formula (1) is, based on acetylcellulose as the binder, from 1 to 12 wt %, preferably from 2 to 9 wt %.

The compound having at least two isocyanate groups for use in the present invention may be an aliphatic compound, an aromatic compound or a mixture of these two type compounds. Specific preferred examples of the compound are set forth below, however, the present invention is by no means limited thereto.

$OCN(CH_2)_6NCO$ (22)

(23)

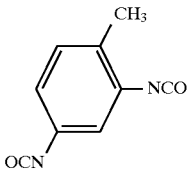

(24)

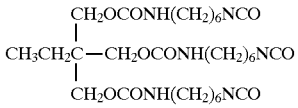

(25)

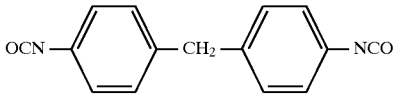

-continued (26)

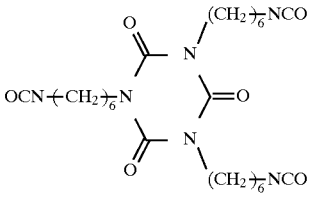

(27)

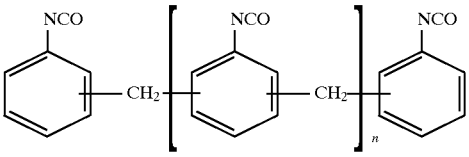

n = 0~2

(28)

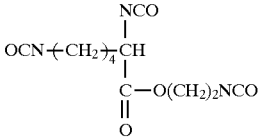

(29)

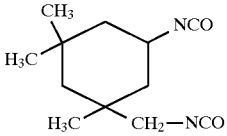

(30)

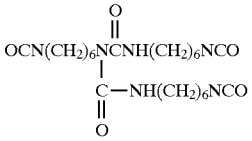

(31)

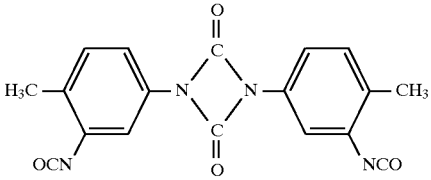

(32)

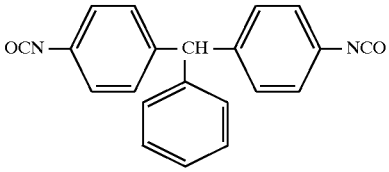

(33)

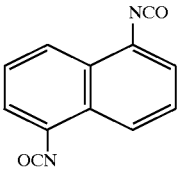

(34)

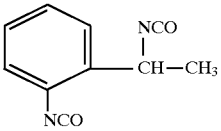

$OCN(CH_2)_8NCO$ (35)

-continued (36)

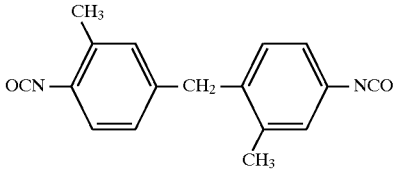

(37)

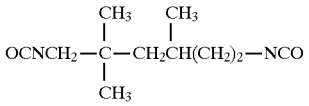

(38)

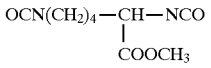

(39)

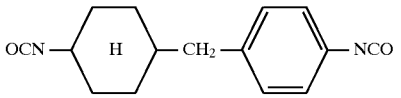

For effectively achieving the objects of the present invention, the addition amount of the isocyanate compound is, based on acetylcellulose as the binder, from 5 to 40 wt %, preferably from 5 to 20 wt %, more preferably from 8 to 16 wt %.

One or more kinds of isocyanate compounds are added to the acetylcellulose layer in the above-described addition amount. In order to accelerate the reaction rate of the isocyanate compound, a tertiary amine such as triethylamine, diazabicyclooctane, triethanolamine and N-methylmorpholine or a metal salt such as dibutyltin laurate, cobalt octenoate, lead octenoate, tin octenoate and zinc octenoate, may be used in combination with the isocyanate compound.

The acetylcellulose for use in the present invention suitably has an acetylation degree (% by weight of acetic acid produced by hydrolyzing 100 g of acetylcellulose) of from 45 to 60%, preferably from 50 to 57%. The acetylcellulose is preferably dissolved in an organic solvent (e.g., acetone, methyl ethyl ketone, diacetone alcohol) together with the maleic anhydride copolymer and isocyanate compound for use in the present invention and then coated. The acetylcellulose layer for use in the present invention preferably contains an ultraviolet absorbent, a slipping agent, a matting agent or the like, if desired.

The support for use in the present invention may be either transparent or opaque, but it is preferably one which undergoes no outstanding dimensional change during the processing. Examples of the support include cellulose acetate film, polystyrene film, polyethylene terephthalate film, polyethylene naphthalate film, polycarbonate film, baryta paper and paper having laminated on the surface thereof with water-impermeable polymer such as polyethylene, which are usually used in photographic light-sensitive materials. At least the outermost layer of the support on the side where the acetylcellulose layer is coated, is subjected to gelatin undercoating.

The gelatin undercoat for use in the present invention may be any undercoat as long as an undercoat having gelatin is provided at the outermost side from the support. A hydrophilic polymer undercoat layer may be provided between the support and the gelatin undercoat layer. The examples of the hydrophilic polymer include polymers of gelatin, methyl cellulose, polyacryl acid ester, polyvinyl alcohol. Further, water emulsion of styrene-butadiene copolymer, polyvinylidene chloride, polyacrylic acid, polyacrylate or polyolefin may be used as the hydrophilic polymer. As the need arises, the undercoat liquid may contain a hardening agent, a surfactant, an antiseptic agent, filler or matting agent.

The undercoat liquid for use in the present invention may be coated to form a single layer or multilayer by a generally known coating method (e.g., dip coating, air-knife coat, curtain coat, roller coat, wirebar coat, gravure coat). It is preferable that the support is surface-treated to have hydrophilic property before undercoating in order to improve the adhesive property between the support and the undercoat layer. As the surface treatment, a corona discharge, glow discharge, ultraviolet irradiation or flame treatment is preferred, with corona discharge treatment being more preferred.

The silver halide emulsion layer used in the light-sensitive sheet of the present invention comprises a silver halide emulsion and the silver halide emulsion may be either surface latent image type or internal latent image type. When the coloring material used in combination with the silver halide emulsion is a coupler or redox compound which reacts with an oxidizing agent as a result of development and releases a diffusible dye (or a precursor thereof), an internal latent image-type direct positive silver halide emulsion is preferably used.

To the silver halide emulsion for use in the present invention, the description of JP-A-2-198445, from page (3), left lower column, line 3 to page (4), left upper column, line 18 can be applied.

The hardening agent of the silver halide emulsion is preferably a vinylsulfone compound described in JP-A-53-41221.

Of the coloring materials used in combination with the silver halide emulsion layer, specific examples of the redox compound (DRR compound) which can imagewise release a diffusible dye as a result of development, include those described in U.S. Pat. No. 3,928,312, 3,993,628, 4,076,529, 4,152,153, 4,055,428, 4,053,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322, 4,371,604 and 4,139,389, JP-A-53-50736, JP-A-52-4819, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Other than those, a dye developer which is diffusible in an alkaline processing solution but oxidized as a result of development and becomes non-diffusible (immobile), may also be used as the coloring material.

The coloring material may be incorporated into the silver halide emulsion layer or into a layer in direct contact with or adjacent through a third layer to the silver halide emulsion.

In the color diffusion transfer process using a DRR compound, any silver halide developer may be used as long as it can cross-oxidize the DRR compound, however, in view of less generation of staining, a black-and-white developer (particularly, pyrazolidinones) is preferably used.

The mordanting layer for the color diffusion transfer process is preferably a hydrophilic colloid layer containing a polymer mordant.

The polymer mordant includes a polymer containing secondary and tertiary amino groups, a polymer having a nitrogen-containing heterocyclic moiety, and a polymer containing a quaternary cation group thereof, each preferably having a molecular weight of from about 5,000 to 200,000, more preferably from 10,000 to 50,000. Examples thereof include an imidazole-base polymer described in JP-A-55-48210, JP-A-55-129346, U.S. Pat. Nos. 4,282,305, 4,273,853, 4,193,796, 4,228,257 and 4,229,515; a polymer mordant capable of cross-linking with gelatin or the like disclosed in U.S. Pat. Nos. 3,625,694, 3,859,096 and 4,128, 538 and British Patent 1,277,453; a latex-type mordant or aqueous sol-type mordant disclosed in U.S. Pat. Nos. 3,958,995, 2,721,852 and 2,798,063, JP-A-54-115228, JP-A-54-145529, JP-A-54-126027 and JP-B-1-51178; and a water-insoluble mordant disclosed in U.S. Pat. No. 3,898,088.

The neutralization layer which can be used in the cover sheet for use in the present invention is preferably a film-forming acidic polymer and any of such acidic polymers may be used. Examples of the acidic polymer include a copolymer of maleic anhydride such as styrene-maleic anhydride copolymer, methyl vinyl ether-maleic anhydride copolymer, ethylene-maleic anhydride copolymer, monobutyl ester of maleic anhydride-methyl vinyl ether copolymer, monoethyl ester of maleic anhydride-ethylene copolymer, monopentyl ester of maleic anhydride-ethylene copolymer, monohexyl ester of maleic anhydride-ethylene copolymer, monoethyl ester of maleic anhydride-methyl vinyl ether copolymer, monopropyl ester of maleic anhydride-methyl vinyl ether copolymer, monobenzyl ester of maleic anhydride-methyl vinyl ether copolymer and monohexyl ester of maleic anhydride-methyl vinyl ether copolymer; a polyacrylic acid; a polymethacrylic acid, a copolymer of acrylic acid and methacrylic acid at various copolymerization ratios; and a copolymer of acrylic acid or methacrylic acid with other vinyl-base monomer such as an acrylic ester (e.g., butyl acrylate), a methacrylic ester, a vinyl ester, an acrylamide or a methacrylamide, at various copolymerization ratios, preferably to have an acrylic or methacrylic acid content of from 50 to 90 mol %. Among these acidic polymers, a polyacrylic acid, an acrylic acid-butyl acrylate copolymer and a maleic anhydride-methyl vinyl ether copolymer are preferred. The above-described polymers may be used either individually or in combination of two or more thereof. Further, for the purpose of increasing the layer strength, a cellulose derivative such as acetylcellulose, or other polymer may be mixed with the acidic polymer on use.

The neutralization timing layer used in combination with the neutralization layer uses as the main component, for example, gelatin, polyvinyl alcohol, polyacrylamide, a partially hydrolyzed polyvinyl acetate, a copolymer of β-hydroxyethyl methacrylate and ethyl acrylate, or acetylcellulose, and other than these, those described in U.S. Pat. Nos. 3,455,686, 3,421,893, 3,785,815, 3,847,615 and 4,009,030, and JP-A-52-14415 may also be used. Further, the neutralization timing layer may be used in combination with a polymer layer having a permeability to the alkaline processing solution greatly dependent on the temperature as described, for example, in U.S. Pat. Nos. 4,056,394 and 4,061,496, JP-A-53-72622 and JP-A-54-78130.

Furthermore, the neutralization timing layer may use a polymer product of a monomer capable of undergoing β desorption in an alkaline environment.

The present invention is described in greater detail below by referring to the Examples and Comparative Examples, however, the present invention should not be construed as being limited thereto.

EXAMPLE 1

On a polyethylene terephthalate film having provided thereon an undercoat layer comprising gelatin, a solution obtained by mixing 100 g of acetylcellulose having an acetylation degree of 55%, 16 g of Isocyanate Compound (24) (75 wt % ethyl acetate solution) of the present invention and 19 g of Copolymer (3) (32 wt % methanol solution) of the present invention in 1,000 ml of acetone, was coated to have a thickness of 100 ml/M$^2$ and dried at 100° C. for 5 minutes to prepare Film Sheet 1.

On a polyethylene terephthalate film having provided thereon an undercoat layer comprising gelatin, a solution obtained by mixing 100 g of acetylcellulose having an acetylation degree of 55%, 10 g of Isocyanate Compound (27) of the present invention and 10 g of Copolymer (3) (32 wt % methanol solution) of the present invention in 1,000 ml of acetone, was coated to have a thickness of 100 ml/m$^2$ and dried at 100° C. for 5 minutes to prepare Film Sheet 2.

On a polyethylene terephthalate film having provided thereon an undercoat layer comprising gelatin, a solution obtained by mixing 100 g of acetylcellulose having an acetylation degree of 55%, 20 g of Isocyanate Compound (24) (75 wt % ethyl acetate solution) of the present invention and 5 g of Copolymer (5) of the present invention in 1,000 ml of acetone, was coated to have a thickness of 100 ml/m$^2$ and dried at 100° C. for 5 minutes to prepare Film Sheet 3.

For comparison, Film Sheet 4 was prepared in the same manner as Film Sheet 1 except for excluding the isocyanate compound and the copolymer in Example 1.

For comparison, Film Sheet 5 was prepared in the same manner as Film Sheet 1 except for excluding the copolymer in Example 1.

For comparison, Film Sheet 6 was prepared in the same manner as Film Sheet 1 except for excluding the isocyanate compound in Example 1.

For comparison, Film Sheet 7 was prepared in the same manner as Film Sheet 1 except for changing the amount of the isocyanate compound added to 4 g in Example 1.

For comparison, Film Sheet 8 was prepared in the same manner as Film Sheet 1 except for changing the amount of the copolymer added to 57 g in Example 1.

Next day after completion of the coating, Film Sheets 1 to 5 were left standing under conditions of 25° C. and 55% RH for 3 hours, and 8 cuts thrusting into the polyethylene terephthalate base were made by a cutter knife (NT Cutter A-300, manufactured by Nippon Tensha-shi KK) every diagonal line in a square of 11 cm (length)×5 cm (width) on the coated surface of each film sheet. On the film sheet surface having the cuts, a knit-polyester pressure sensitive adhesive tape (No. 31, produced by Nitto Denko KK) was evenly adhered, and then, the pressure sensitive adhesive tape was vigorously peeled off. The area of the acetylcellulose layer which was Not peeled off with the pressure sensitive adhesive tape was obtained and the interlayer adhesive strength was evaluated by the area. The results obtained are shown in Table 1. The larger the value, the higher the interlayer adhesive strength.

TABLE 1

| Film Sheet No. | Area Not Peeled Off (%) |
|---|---|
| 1 (Invention) | 100 |
| 2 (Invention) | 100 |
| 3 (Invention) | 100 |
| 4 (Comparison) | 0 |
| 5 (Comparison) | 5 |
| 6 (Comparison) | 0 |
| 7 (Comparison) | 0 |
| 8 (Comparison) | 10 |

It is seen from Table 1 that the acetylcellulose layers of the present invention only have an excellent interlayer adhesive property.

EXAMPLE 2

A sample was prepared in the same manner as Sample No. 1 in Example 1 of JP-A-7-333782 except for using Film Sheet 1 of the present invention on the cover sheet back surface side. Evaluation of photographic properties was performed and it was verified that no adverse effect was caused.

By having a construction of the photographic element of the present invention such that a back layer comprising a copolymer of acetylcellulose/isocyanate compound/formula (1) in a specific weight ratio is provided on a base applied with gelatin undercoat, an excellent effect can be obtained on the interlayer adhesion.

While the invention has been described in detail and with reference to specific embodiments thereof, it will be apparent to one skilled in the art that various changes and modifications can be made therein without departing from the spirit and scope thereof.

What is claimed is:

1. A photographic element comprising a support having a gelatin undercoat, having provided thereon an acetylcellulose layer containing from 1.0 to 12.0 wt % of a polymer represented by the following formula (1) and from 5 to 40 wt % of a compound having at least two isocyanate groups, both based on acetylcellulose contained in the acetylcellulose layer:

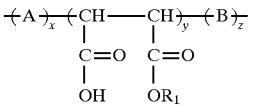

(1)

wherein A represents a polymerized comonomer component represented by formula (2); $R_1$ represents an alkyl group, an aryl group or an aralkyl group; B represents other polymerized ethylenical comonomer component; x represents from 20 to 90 mol %; y represents from 10 to 80 mol %; and z represents from 0 to 30 mol %:

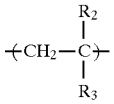

(2)

wherein $R_2$ represents a hydrogen atom, a halogen atom or a methyl group; $R_3$ represents a hydrogen atom, a halogen atom, an alkyl group, an aryl group, a $—(CH_2)_n—O—R_4$ group, a $—(CH_2)_n—O—CO—R_5$ group or a $—CO—O—R_6$ group, $R_4$ represents an alkyl group or an aralkyl group; $R_5$ and $R_6$ are the same or different and each represents an alkyl group, an aryl group or an aralkyl group; and n represents 0 or 1.

2. A photographic element comprising a support having a gelatin undercoat, having provided thereon an acetylcellulose layer containing from 2.0 to 9.0 wt % of a polymer represented by formula (1) in claim 1 and from 5 to 20 wt % of a compound having at least two isocyanate group, both based on acetylcellulose contained in the acetylcellulose layer.

3. A diffusion transfer photographic light-sensitive material comprising a photographic element described in claim 2.

4. A photographic element according to claim 1, wherein the polymer represented by formula (1) has a weight average molecular weight of 5,000 to 500,000.

5. A photographic element according to claim 2, wherein the compound having at least two isocyanate group is a compound having at least three isocyanate group.

6. A photographic element according to claim 1, wherein the acetylcellulose has an acetylation degree of from 50 to 57%.

7. A photographic element according to claim 1, wherein the support is subjected to corona discharge treatment before coating the undercoat layer.

* * * * *